US006618883B2

(12) United States Patent
Angland

(10) Patent No.: US 6,618,883 B2
(45) Date of Patent: Sep. 16, 2003

(54) MATTRESS SUPPORT DEVICE FOR A SOFA SLEEPER

(76) Inventor: Clair A. Angland, 19233 Viking Bay Rd. NW., Parkers Prairie, MN (US) 56361

( * ) Notice: Subject to any disclaimer, the term of this patent is extended or adjusted under 35 U.S.C. 154(b) by 0 days.

(21) Appl. No.: 10/059,531

(22) Filed: Jan. 30, 2002

(65) Prior Publication Data

US 2003/0140423 A1 Jul. 31, 2003

(51) Int. Cl.[7] ..... A47C 31/00
(52) U.S. Cl. ..... 5/659; 5/417; 5/420; 5/12.1
(58) Field of Search ..... 5/12.1, 417, 420, 5/659, 657

(56) References Cited

U.S. PATENT DOCUMENTS

| | | | | | |
|---|---|---|---|---|---|
| 2,551,976 | A | * | 5/1951 | Smith | 5/630 |
| 2,576,455 | A | * | 11/1951 | Graft | 5/701 |
| 2,589,579 | A | | 3/1952 | Slayen | 5/357 |
| 2,847,685 | A | * | 8/1958 | Freedlander | 5/659 |
| 3,125,768 | A | * | 3/1964 | Rickert | 5/659 |
| 3,140,897 | A | * | 7/1964 | Dougherty | 297/378.1 |
| 3,319,274 | A | | 5/1967 | Upton | 5/345 |
| 3,323,151 | A | * | 6/1967 | Lerman | 5/722 |
| 3,370,306 | A | * | 2/1968 | Lovette | 5/659 |
| 3,846,857 | A | | 11/1974 | Weinstock | 5/345 |
| 4,365,371 | A | | 12/1982 | Boussaroque | 5/462 |
| 4,639,952 | A | | 2/1987 | Kensinger | 5/13 |
| 4,662,851 | A | * | 5/1987 | Foster | 441/129 |
| 4,768,251 | A | | 9/1988 | Baskent | 5/464 |
| 4,815,155 | A | | 3/1989 | Sommers | |
| 4,860,396 | A | * | 8/1989 | Vogel, II | 5/659 |
| 4,862,537 | A | | 9/1989 | Riley | |
| 4,985,952 | A | * | 1/1991 | Edelson | 5/722 |
| D338,120 | S | | 8/1993 | Pauer et al. | |
| D340,160 | S | | 10/1993 | Graham | |
| 5,491,851 | A | * | 2/1996 | Alonso | 5/722 |
| 5,611,414 | A | * | 3/1997 | Walker | 190/2 |
| 5,669,089 | A | * | 9/1997 | Dees | 5/419 |
| 5,950,260 | A | * | 9/1999 | Dees | 5/420 |

OTHER PUBLICATIONS

See enclosure.

www.hometrendscatalog.com, Jan. 29, 2002, Bed Board—Twin.

* cited by examiner

*Primary Examiner*—Teri Pham Luu
(74) *Attorney, Agent, or Firm*—Albert W. Watkins

(57) ABSTRACT

A mattress support device for a sofa sleeper for protecting an individual from the support bars beneath the mattress in a sofa sleeper. The mattress support device for a sofa sleeper includes a first section, a second section pivotally attached to the first section and a third section pivotally attached to the second section. The second section and the third section are pivotally attached to one another by a first hinge channel extending into an upper surface between thereof. The first section and second section are pivotally attached to one another by a second hinge channel extending into a lower surface between thereof. The first section, second section and third section are preferably comprised of a solid sheet structure with the channels formed or created within to create hinges within.

18 Claims, 9 Drawing Sheets

MATTRESS SUPPORT DEVICE FOR A SOFA SLEEPER

CROSS REFERENCE TO RELATED APPLICATIONS

I hereby claim benefit under Title 35, United States Code, Section 119(e) of U.S. provisional patent application Serial No. 60/349,753 filed Jan. 22, 2002 entitled "Folding Hide-a-Bed Buffer". This application is a continuation of the provisional application. The provisional application is currently pending. The provisional application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to sofa sleepers and more specifically it relates to a mattress support device for a sofa sleeper for protecting an individual from the support bars beneath the mattress in a sofa sleeper.

2. Description of the Prior Art

Sofa sleepers have been in use for years. Conventional sofa sleepers (a.k.a. "hide-a-beds") are comprised of a conventional sofa structure that additionally houses a support frame and mattress within. The support frame and mattress are configured to be are folded outwardly into a bed structure when additional sleeping arrangements are required.

The main problem with conventional sofa sleepers is that support members within the support frame extend through and impact an individual sleeping upon the mattress thereby causing significant discomfort. Examples of patented devices which are related to the present invention include U.S. Pat. No. 3,846,857 to Weinstock; U.S. Pat. No. 4,639,952 to Kensinger; U.S. Pat. No. 2,589,579 to Slayen; U.S. Pat. No. 4,365,371 to Boussaroque; U.S. Pat. No. 3,319,274 to Upton; U.S. Pat. No. 4,768,251 to Baskent.

While these devices may be suitable for the particular purpose to which they address, they are not as suitable for protecting an individual from the support bars beneath the mattress in a sofa sleeper. Conventional sofa sleepers are difficult to utilize for sleeping upon the mattress because of the horizontal support bars.

In these respects, the mattress support device for a sofa sleeper according to the present invention substantially departs from the conventional concepts and designs of the prior art, and in so doing provides an apparatus primarily developed for the purpose of protecting an individual from the support bars beneath the mattress in a sofa sleeper.

SUMMARY OF THE INVENTION

In view of the foregoing disadvantages inherent in the known types of sofa sleeper accessories now present in the prior art, the present invention provides a new mattress support device for a sofa sleeper construction wherein the same can be utilized for protecting an individual from the support bars beneath the mattress in a sofa sleeper.

The general purpose of the present invention, which will be described subsequently in greater detail, is to provide a new mattress support device for a sofa sleeper that has many of the advantages of the sofa sleeper accessories mentioned heretofore and many novel features that result in a new mattress support device for a sofa sleeper which is not anticipated, rendered obvious, suggested, or even implied by any of the prior art sofa sleeper accessories, either alone or in any combination thereof.

To attain this, the present invention generally comprises a first section, a second section pivotally attached to the first section and a third section pivotally attached to the second section. The second section and the third section are pivotally attached to one another by a first hinge channel extending into an upper surface there between. The first section and second section are pivotally attached to one another by a second hinge channel extending into a lower surface there between. The first section, second section and third section are preferably comprised of a solid sheet structure with the channels formed or created within to create hinges.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a mattress support device for a sofa sleeper that will overcome the shortcomings of the prior art devices.

A second object is to provide a mattress support device for a sofa sleeper for protecting an individual from the support bars beneath the mattress in a sofa sleeper.

Another object is to provide a mattress support device for a sofa sleeper that may be utilized upon various sizes of sofa sleepers and mattresses.

An additional object is to provide a mattress support device for a sofa sleeper that is foldable into a compact storage position.

A further object is to provide a mattress support device for a sofa sleeper that may be conveniently stored within the sofa sleeper during non-usage thereof.

Another object is to provide a mattress support device for a sofa sleeper that is comprised of a rigid structure sufficient to reduce the impact of frame support bars within the a sofa sleeper positioned beneath the mattress.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
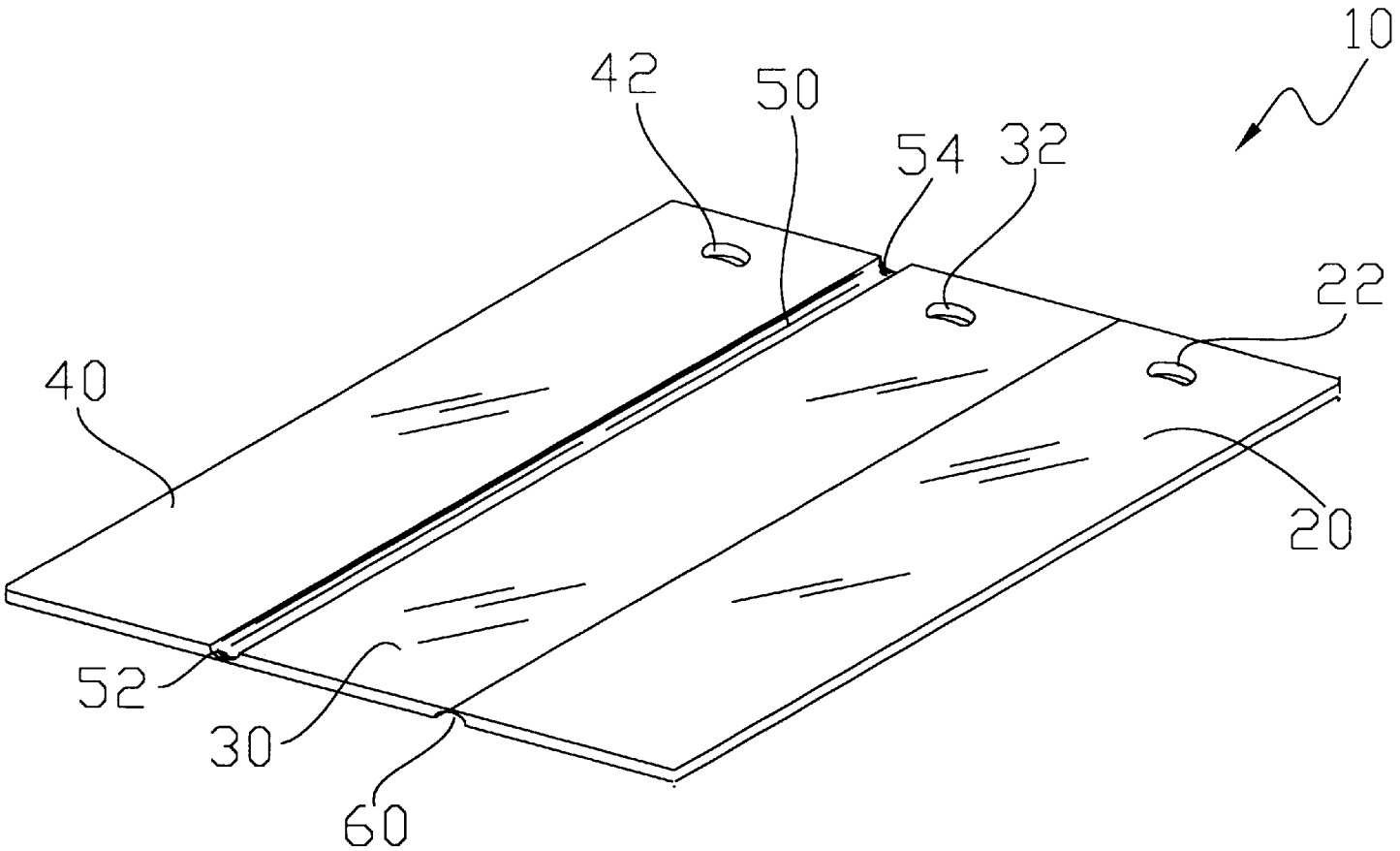
FIG. 1 is an upper perspective view of the present invention.

Turning now descriptively to the drawings, in which similar reference characters denote similar elements throughout the several views, FIGS. 1 through 10 illustrate a mattress support device for a sofa sleeper, which comprises a first section 20, a second section 30 pivotally attached to the first section 20 and a third section 40 pivotally attached to the second section 30. The second section 30 and the third section 40 are pivotally attached to one another by a first hinge channel 50 extending into an upper surface there between. The first section 20 and second section 30 are pivotally attached to one another by a second hinge channel 60 extending into a lower surface there between. The first section 20, second section 30 and third section 40 are preferably comprised of a solid sheet structure with the channels formed or created within to create hinges.

Figure 3:
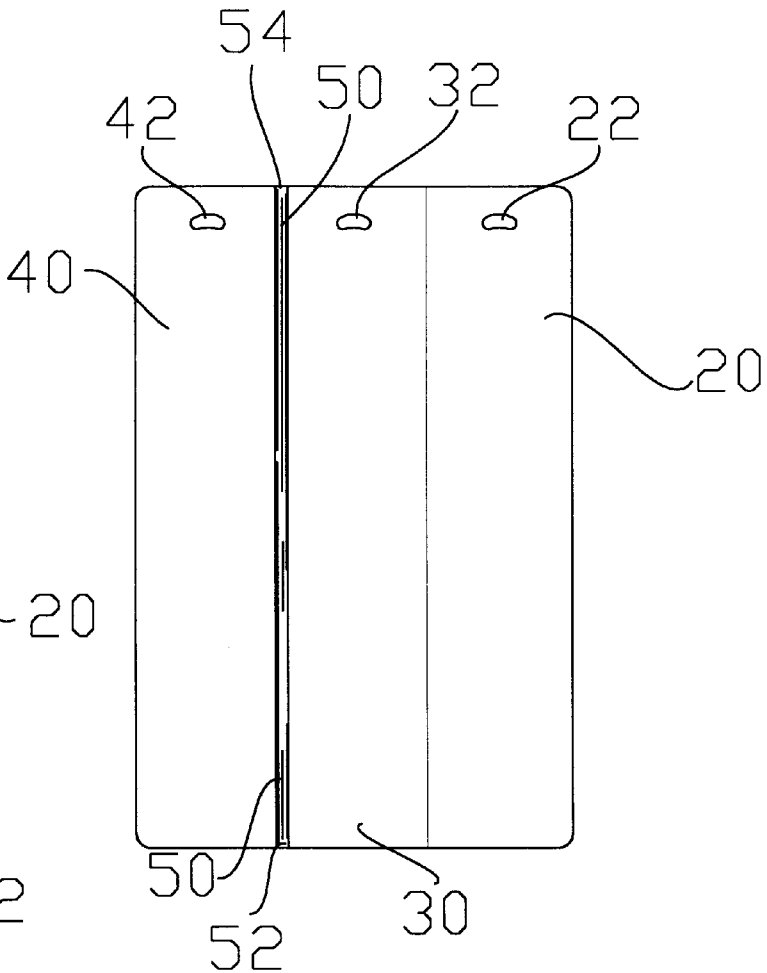
FIG. 3 is a bottom view of the present invention.
Figure 2:
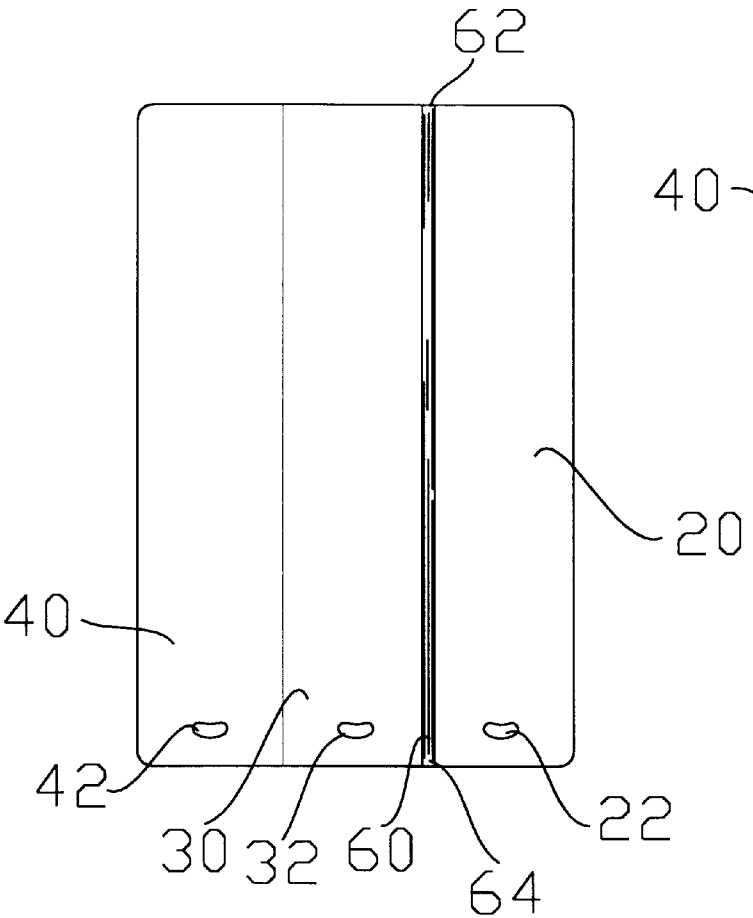
FIG. 2 is a top view of the present invention.
Figure 4:
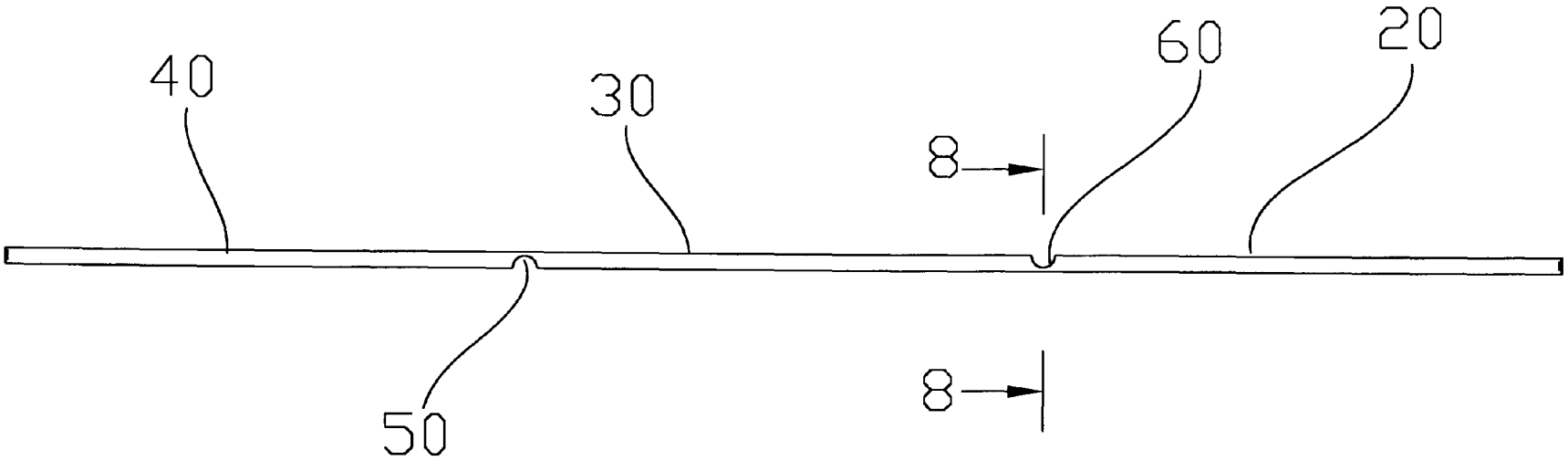
FIG. 4 is an end view of the present invention fully expanded.

As shown in FIGS. 1 and 4 of the drawings, the present invention is comprised of a generally flat solid structure identified as the sheet member 10. The sheet member 10 preferably has a rectangular structure with rounded corners, though other shapes may be used as shown in FIGS. 2 and 3 of the drawings. The present invention may have various thicknesses such as but not limited to ¾ of an inch. The present invention may also have various widths and lengths as required to properly fit between the support frame 16 and the mattress 14 so that the support bars within the support frame 16 are properly protected against. The present invention is preferably comprised of a solid sheet of plastic such as but not limited to high density polyethylene (HDPE). Various other materials may also be utilized to construct the present invention.

Figure 5:
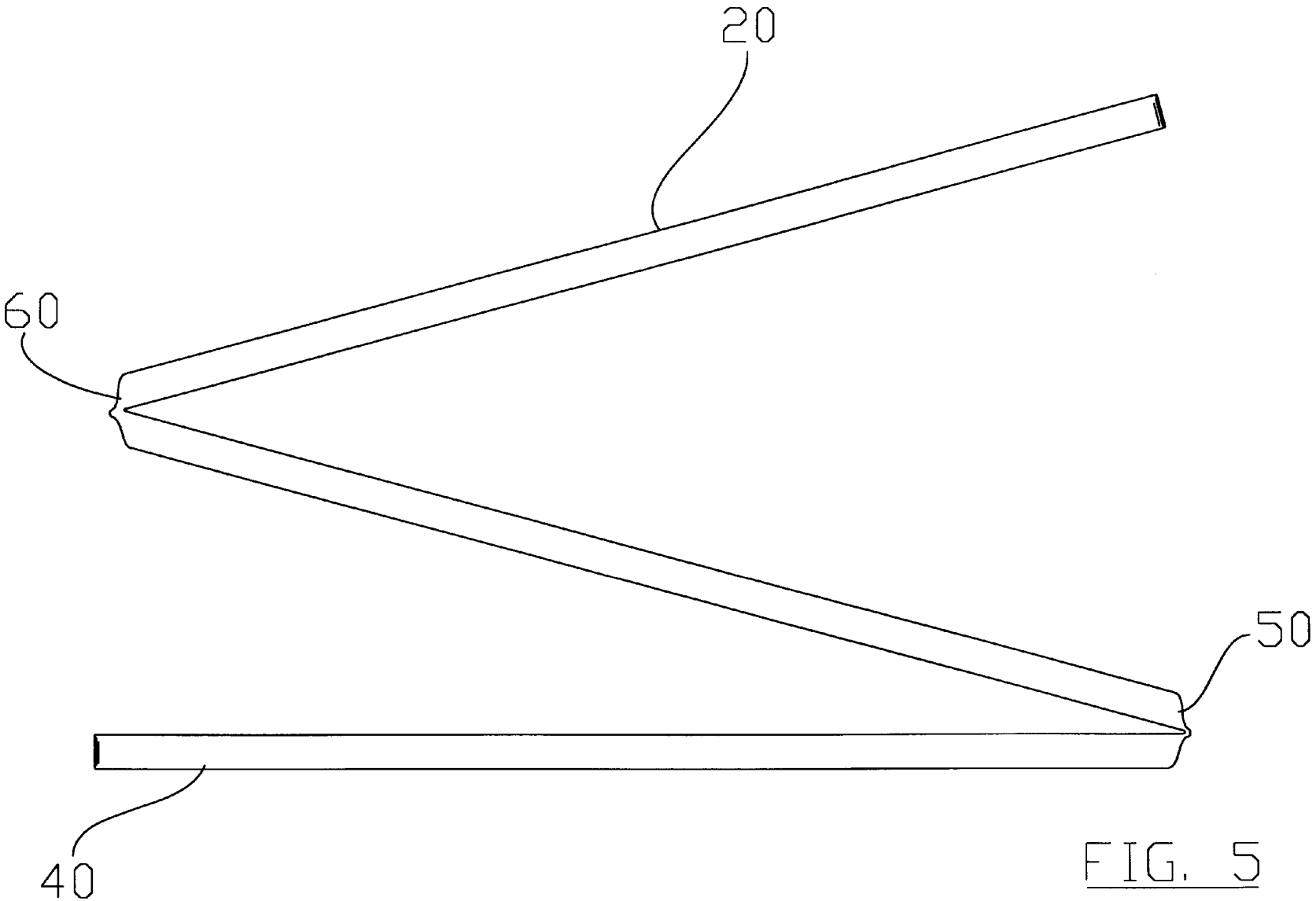
FIG. 5 is an end view of the present invention partially folded.
Figure 6:
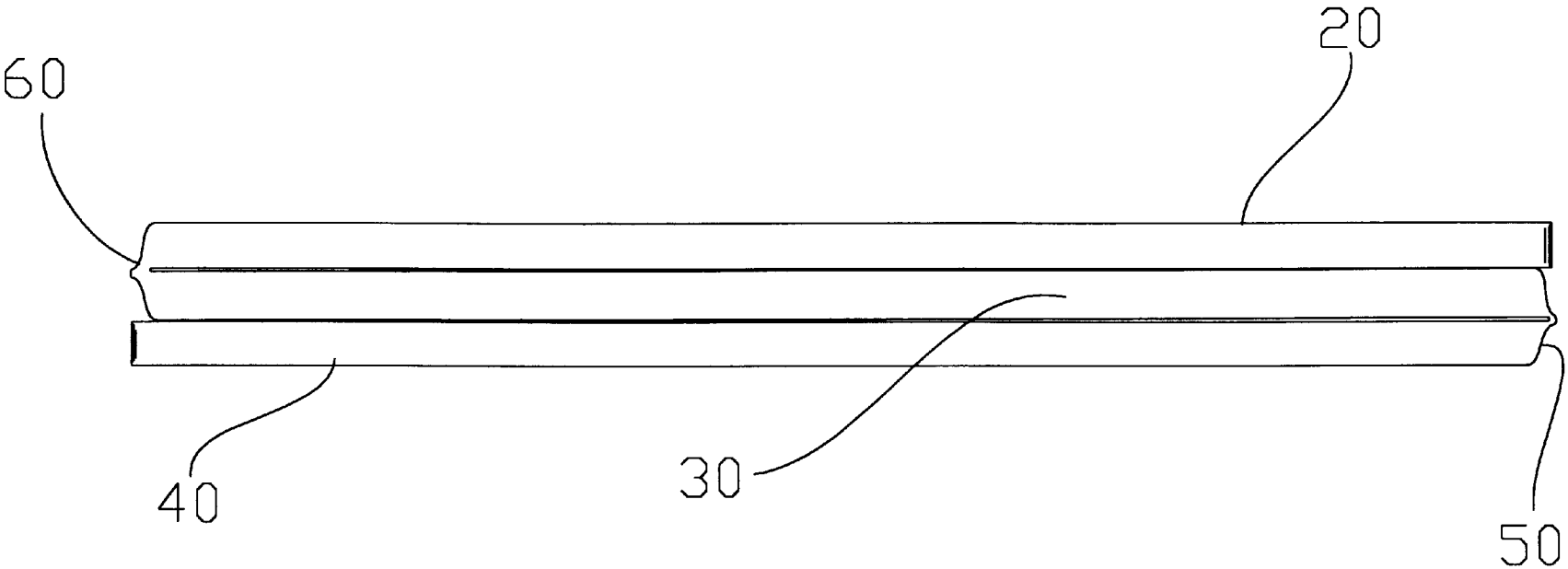
FIG. 6 is an end view of the present invention completely folded.

As shown in FIGS. 1 and 3 of the drawings, a first hinge channel 50 extends into a lower surface of the sheet member 10 parallel to a side of the sheet member thereby dividing the third section 40 from the second section 30. The first hinge channel 50 may have a V-shaped or U-shaped cross sectional shape. FIG. 4 illustrates the usage of a U-shaped cross sectional shape. The first hinge channel 50 extends along the entire length of the sheet member thereby allowing the third section 40 to be folded upon the second section 30 opposite of the first section 20 as shown in FIG. 5 of the drawings. The first hinge channel 50 may have various depths within the sheet member to create a flexible and strong hinge. In the preferred embodiment using HDPE, the inventor has found that a thickness of approximately 0.02 inches is desirable within the first hinge channel 50 at the lowest point.

As shown in FIG. 2 of the drawings, a second hinge channel 60 extends into a lower surface of the sheet member 10 parallel to a side of the sheet member thereby dividing the first section 20 from the second section 30. The second hinge channel 60 may have a V-shaped or U-shaped cross sectional shape. FIG. 4 illustrates the usage of a U-shaped cross sectional shape. The second hinge channel 60 extends along the entire length of the sheet member thereby allowing the first section 20 to be folded upon the second section 30 opposite of the third section 40 as shown in FIG. 5 of the drawings. The second hinge channel 60 may have various depths within the sheet member to create a flexible and strong hinge. In the preferred embodiment using HDPE, the inventor has found that a thickness of approximately .02 inches is desirable within the second hinge channel 60 at the lowest point.

It can be appreciated that the hinge channels 50, 60 may be either directly formed within the sheet member during manufacture and cut into the sheet member with a router or other conventional tooling. Various manufacturing methods may be utilized to create the hinge channels 50, 60 within the sheet member that are not illustrated but are deemed readily apparent to one skilled in the art.

As shown in FIGS. 1 though 3 of the drawings, the first section 20, the second section 30 and the third section 40 all preferably have approximately the same width and length respective to one another. It can be appreciated that the members 20, 30, 40 may have differing widths and lengths for various situations.

Figure 8:
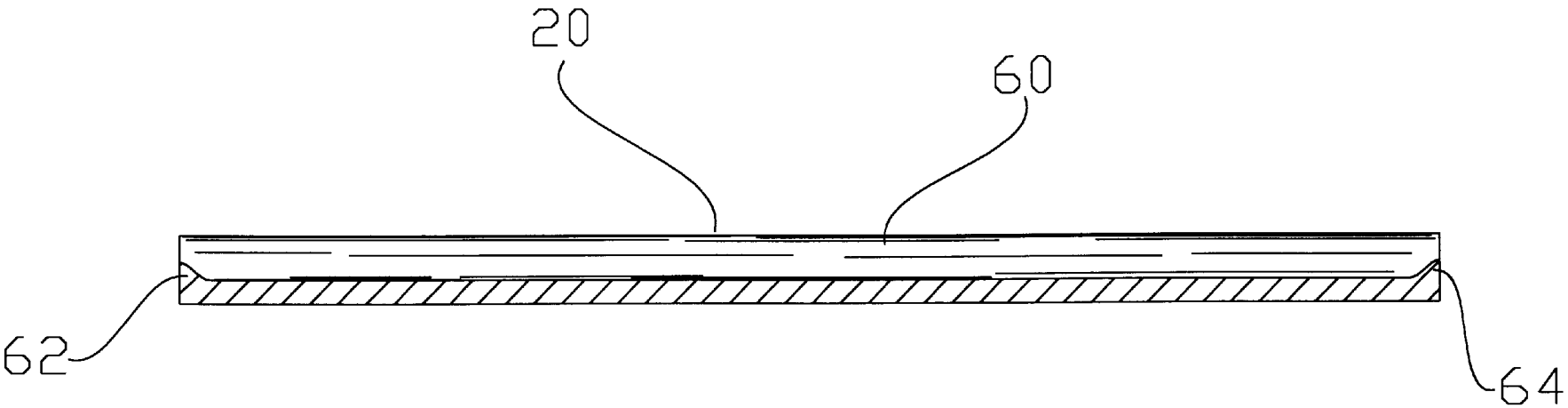
FIG. 8 is a cross sectional view taken along line 8—8 of FIG. 4.
Figure 9:
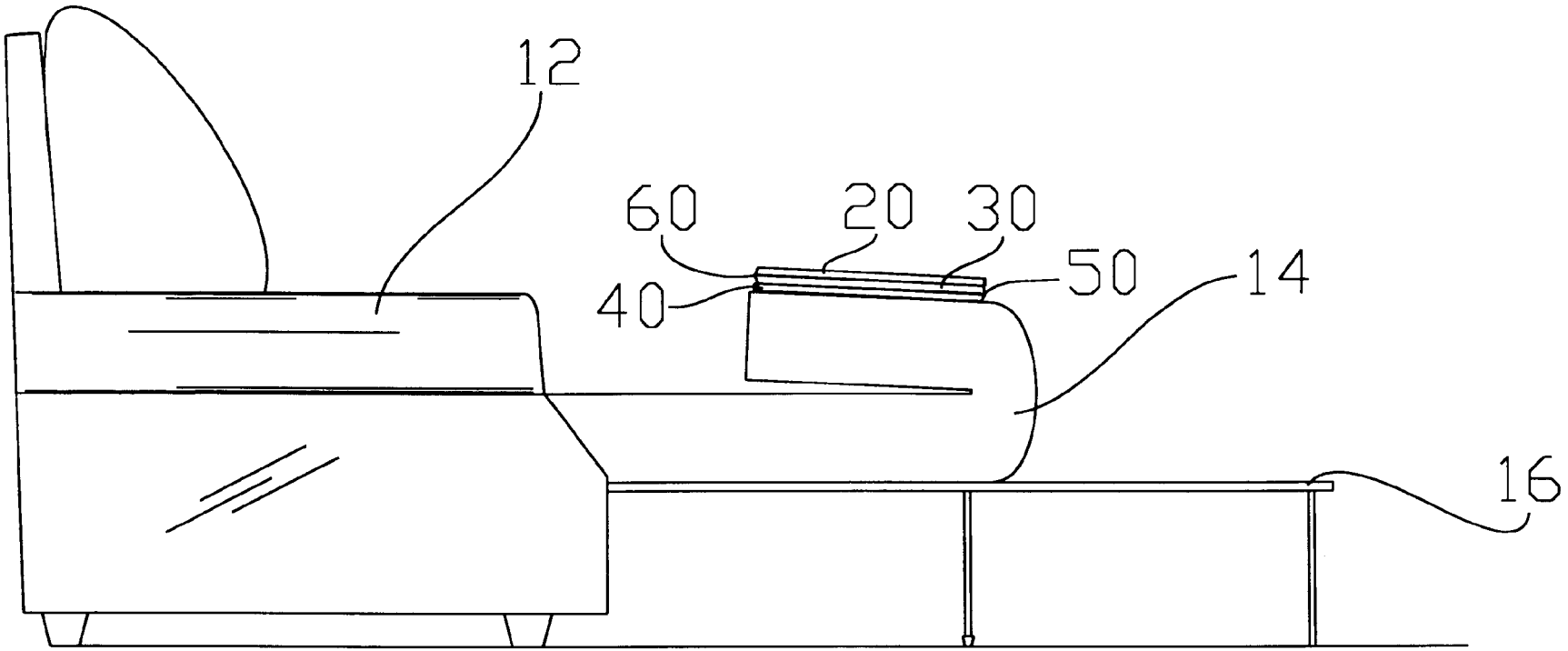
FIG. 9 is a side view of the present invention positioned upon a mattress when the frame is removed from the sofa sleeper.

As shown in FIGS. 1 through 3 of the drawings, the first hinge channel 50 and the second hinge channel 60 include a first end 52, 62 and a second end 54, 64 respectively. The ends 52, 54, 62, 64 preferably are tapered upwardly to increase the thickness at the distal ends of the hinge channels 50, 60 for increasing the outer edge strength of the hinge channels 50, 60 as best illustrated in FIG. 8 of the drawings. The ends 52, 54, 62, 64 may have various thicknesses and shapes as can be appreciated and are preferably greater in thickness than .02 inches when utilized with HDPE.

Figure 7:
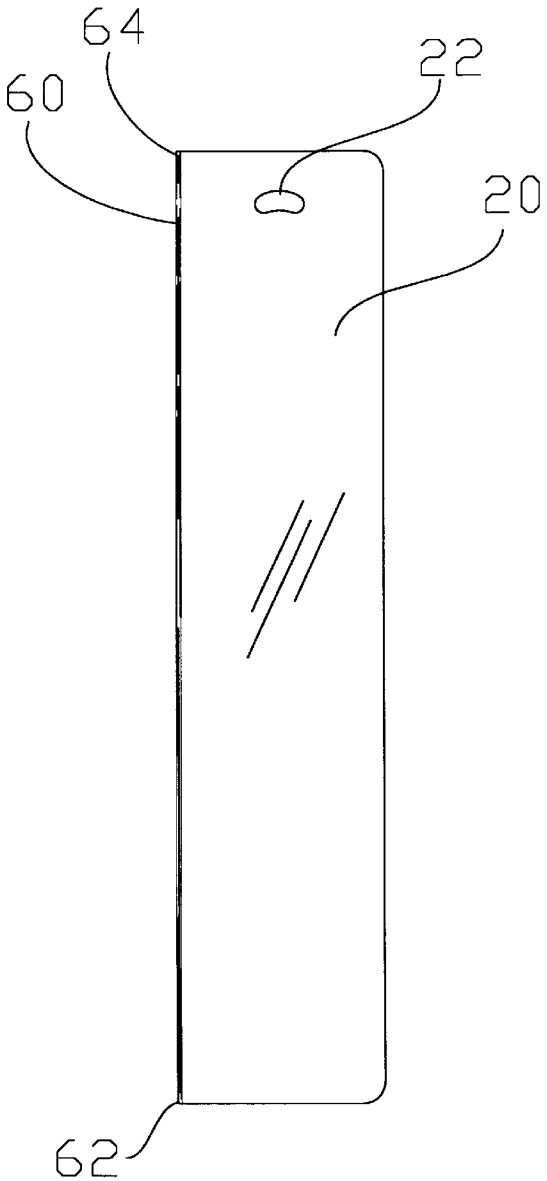
FIG. 7 is a top view of the present invention completely folded.

As shown in FIGS. 1 through 3 of the drawings, a plurality of apertures 22, 32, 42 extend into the members 20, 30, 40 respectively. The apertures 22, 32, 42 are each formed to ergonomically receive the hand of an individual utilizing the present invention. The apertures 22, 32, 42 preferably have a curved shape facing the outer edge of the sheet member as shown in FIGS. 2 and 3 of the drawings. It can be appreciated that various other shapes may be utilized to construct the apertures 22, 32, 42 within the members 20, 30, 40. The apertures 22, 32, 42 are preferably centered within the members 20, 30, 40 and have a similar shape so that when the sheet member is folded up, the apertures 22, 32, 42 are aligned to allow the individual to insert their hand through the apertures 22, 32, 42 as shown in FIG. 7 of the drawings.

Figure 10:
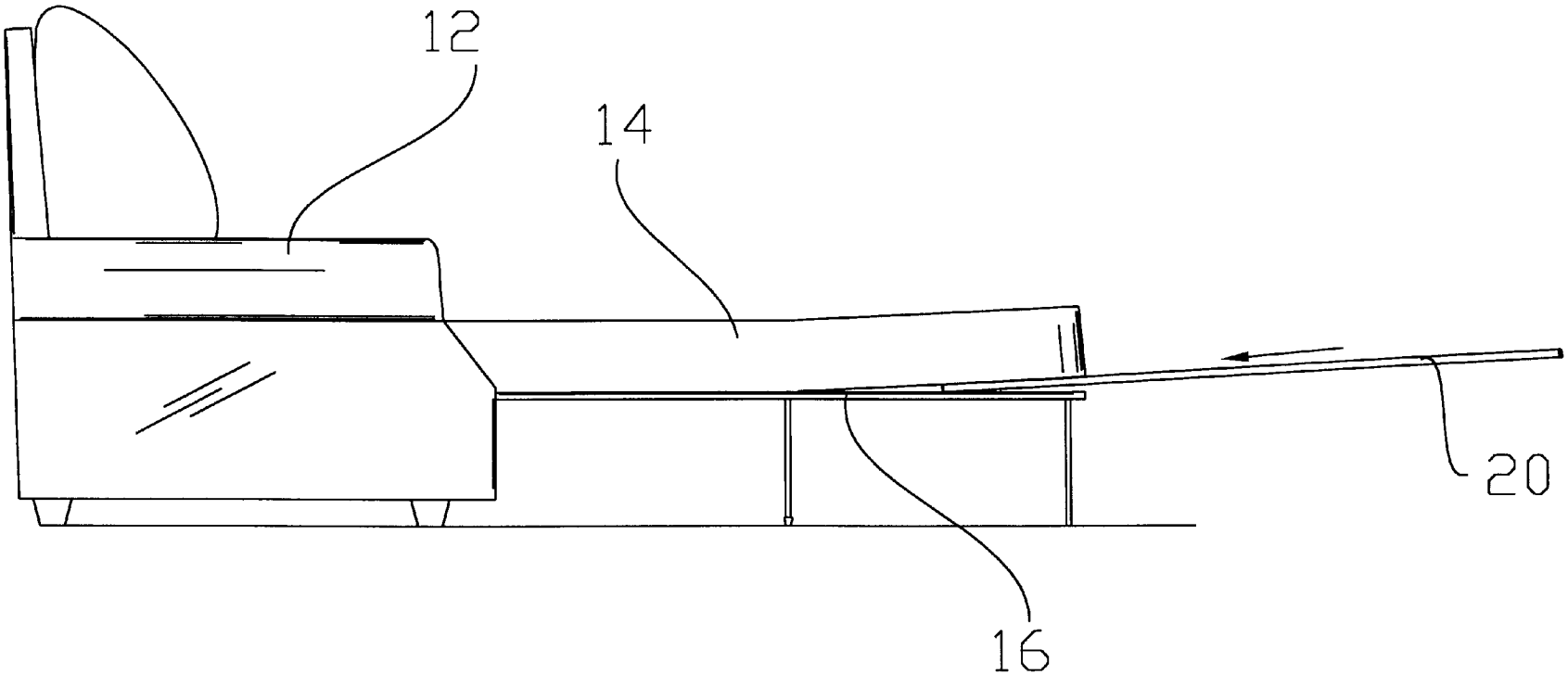
FIG. 10 is a side view of the present invention being inserted between the mattress and the support frame.

In use, the user folds the sheet member into a compact structure and places the folded sheet member within the sofa sleeper 12 in a desired location such as between the frame and the mattress 14 or directly within the mattress 14. Various locations may be utilized to store the folded sheet member as can be appreciated. When the user desires to utilize the bed portion of the sofa sleeper 12, the individual folds out the support frame 16 from the sofa sleeper 12 as is readily apparent within the art. The user then removes the folded sheet member from the sofa sleeper 12 and properly positions the mattress 14 upon the support frame 16. The user then unfolds the rigid sheet member until a generally flat structure is formed as shown in FIGS. 1 through 4 of the drawings. The user then elevates the front of the mattress 14 from the support frame 16 and inserts the end of the sheet member opposite of the apertures 22, 32, 42 beneath the mattress 14 and the support frame 16 as shown in FIG. 10 of the drawings. The user continues to apply force upon the sheet member until the sheet member is properly positioned between the mattress 14 and the support frame 16 to properly protect the individual from the support bars within the support frame 16 while sleeping upon the mattress 14. When the individual is finished using the mattress 14, the above process is simply reversed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mattress support device for a sofa sleeper, comprising:

a sheet member having a first section, a second section and a third section extending parallel to one another;

a first hinge channel extending longitudinally, within a lower surface of said sheet member between said second section and said third section creating a hinge structure; and a second hinge channel extending longitudinally within an upper surface of said sheet member between said first section and said second section creating a hinge structures;

said first hinge channel and said second hinge channel each having a first end and a second, end, wherein said first end and said second end are tapered to provide an increased thickness of said sheet member relative to a middle portion of said hinge channels.

2. The mattress support device for a sofa sleeper of claim 1, wherein said first hinge channel is parallel to said second hinge channel.

3. The mattress support device for a sofa sleeper of claim 1, wherein said first hinge channel and said second hinge channel each have a U-shaped cross section.

4. The mattress support device for a sofa sleeper of claim 1, wherein said first hinge channel and said second hinge channel each have a V-shaped cross section.

5. The mattress support device for a sofa sleeper of claim 1, wherein said sheet member has a thickness of at least 0.02 inches at said first hinge channel and said second hinge channel.

6. The mattress support device for a sofa sleeper of claim 1, wherein said first end and said second end are curved.

7. The mattress support device for a sofa sleeper of claim 1, wherein said sheet member has a rectangular shape.

8. The mattress support device for a sofa sleeper of claim 1, including a first aperture within said first section, a second aperture within said second section and a third aperture within said third section.

9. The mattress support device for a sofa sleeper of claim 8, wherein said apertures are centrally aligned within said sections such that when said sheet member is folded said apertures are aligned within one another.

10. A mattress support device for a sofa sleeper, comprising:

a sheet member comprised of high density polyethylene having a first section, a second section and a third section extending parallel to one another;

a first hinge channel extending longitudinally within a lower surface of said sheet member between said second section and said third section creating a hinge structure; and a second hinge channel extending longitudinally within an upper surface of said sheet member between said first section and said second section creating a hinge structure;

said first hinge channel and said second hinge channel each having a first end and a second end, wherein said first end and said second end are tapered to provide an increased thickness of said sheet member relative to a middle portion of said hinge channels.

11. The mattress support device for a sofa sleeper of claim 10, wherein said first hinge channel is parallel to said second hinge channel.

12. The mattress support device for a sofa sleeper of claim 10, wherein said first hinge channel and said second hinge channel each have a U-shaped cross section.

13. The mattress support device for a sofa sleeper of claim 10, wherein said first hinge channel and said second hinge channel each have a V-shaped cross section.

14. The mattress support device for a sofa sleeper of claim 10, wherein said sheet member has a thickness of at least 0.02 inches at said first hinge channel and said second hinge channel.

15. The mattress support device for a sofa sleeper of claim 10, wherein said first end and said second end are curved.

16. The mattress support device for a sofa sleeper of claim 10, wherein said sheet member has a rectangular shape.

17. The mattress support device for a sofa sleeper of claim 10, including a first aperture within said first section, a second aperture within said second section and a third aperture within said third section.

18. The mattress support device for a sofa sleeper of claim 17, wherein said apertures are centrally aligned within said sections such that when said sheet member is folded said apertures are aligned within one another.

* * * * *